US005259449A

United States Patent [19]

Case

[11] Patent Number: 5,259,449

[45] Date of Patent: Nov. 9, 1993

[54] HEAT EXCHANGER ASSEMBLY III

[75] Inventor: Sigurd Case, Frewsburg, N.Y.

[73] Assignee: Valeo Engine Cooling Incorporated, Jamestown, N.Y.

[21] Appl. No.: 937,501

[22] Filed: Aug. 28, 1992

[51] Int. Cl.[5] ..... F28F 9/02

[52] U.S. Cl. ..... 165/173; 165/153; 29/890.043; 29/890.052

[58] Field of Search ..... 165/173, 175, 153; 29/890.052, 890.043

[56] References Cited

U.S. PATENT DOCUMENTS 4,749,033 6/1988 Clausen ..... 165/173

4,945,635 8/1990 Nobusue et al. ..... 165/173

5,052,478 10/1991 Nabajima et al. ..... 165/173

*Primary Examiner*—Albert W. Davis, Jr.

*Attorney, Agent, or Firm*—Morgan & Finnegan

[57] ABSTRACT

A heat exchanger assembly which comprises spaced tubular header and tank constructions between which a plurality of tubular elements whose open ends are inserted in slots in the header surface or tube member receiving portions. The header surface or tube member receiving portion has a plurality of center elements. The apexes of each center portion between the tubular element slots have a flattened area and there are side portions running downward from the center portion apex flats which also are substantially flattened.

6 Claims, 3 Drawing Sheets

HEAT EXCHANGER ASSEMBLY III

The present invention relates to improved heat exchanger assemblies of the type in which spaced generally parallel header and tank constructions are interconnected by tubular elements which are preferably separated by separator means.

BACKGROUND OF THE INVENTION

Many types of heat exchangers in use today employ two spaced header and tank constructions. Generally parallel, open ended tubes interconnect the header and tank constructions and are in fluid communication with the interior of each. In many cases, plate or serpentine fins are disposed across the tubes between the header and tank constructions. Typical examples of such heat exchangers are vehicular radiators and condensers, although such heat exchangers may be found in many other applications as well.

Assembly of heat exchangers by the insertion of open-ended tubes into holes in opposing header portions of header and tank constructions has posed difficulties in the past. The tubes are often made of materials which are relatively soft and, hence, the tubes can easily be damaged during insertion into the holes on the headers, especially on a mass production basis. Such damage can include the bending of the tube walls or end, which can either restrict or hinder fluid flow therethrough.

It is difficult to assemble the parts of the header and tank construction and it is difficult to precisely position the tubular elements and maintain the proper distances between them.

The present invention is directed to overcoming one or more of the above problems.

BRIEF DESCRIPTION OF THE INVENTION

In the present invention, the header and tank construction for use in a heat exchanger comprises a tube member receiving surface and a base surface. The tube member receiving surface has a plurality of elongated tube-member receiving slots and center portion between the slots wherein each center portion has a substantially flat apex portion and substantially flat side portions extending transversely from each flat apex portion. Extending longitudinally from each center portion is a camming surface for facilitating the insertion of tube-members into the slots. Each camming surface extends longitudinally from a center portion toward the slots adjacent to the center portion.

DETAILED DESCRIPTION OF THE INVENTION

The heat exchanger of the present invention comprises spaced generally parallel header and tank constructions and a plurality of tubular elements whose opposite ends are connected to the header and tan construction.

A core assembly comprising tubular elements between which are placed spacers is inserted in elongated, spaced receiving slots in the separate header surfaces of the header and tank constructions.

The slots of one header of the assembly are aligned and face corresponding slots in the other header surface and the tubular elements extend between the header and tank constructions through the aligned slots of the separate header portions.

The heat exchanger assembly may contain partitioned areas or chambers within the separate header and tank constructions. The partitions are formed by baffle plates within the header and tank construction which divide the header and tank construction into separate chambers.

The portions of the header surfaces bordering each of the elongated slots for the tubular elements and generally above the slots comprise center portions each of which have a chordal substantially flattened area running transversely along the header surface. The apex flat and the transverse side portion flats in conjunction with a camming surface integral with the side portions aid in creating a steep funnel effect for camming the tubular members into the header slots. The elongated slots between the center and side portions with flats are defined by the camming surface bordering each of the elongated slots. The presence of a steep entry provided by the camming surface is important for high speed assembly of many tubes at a time into the matching slots of the header constructions. The present invention prevents and/or minimizes damage to the tube walls and ends.

The apex flats also produce more uniformity of dimension of the fillets with the walls closer for better bonding and joint strength.

The header and tank construction of the present invention can also include bosses on the base surface of the header and tank construction opposite the apex flat of the center portions. The opposing boss helps the header to be grabbed and be held in the correct rotational and parallel position during perpendicular insertion of tubes and brackets.

In a further embodiment of the present invention, an inside flat is automatically created in the stamping operation. A punch die used in the stamping that holds the metal of the header construction against deformation is flat to resist the punch. This inside flat advantageously helps locate the baffles for high speed production.

The embodiment specifically described herein is an integral construction. However, the present invention also encompasses embodiments in which the header and tank construction is made from separate header and tank portions.

DETAILED DESCRIPTION OF THE FIGURES

Figure 1:
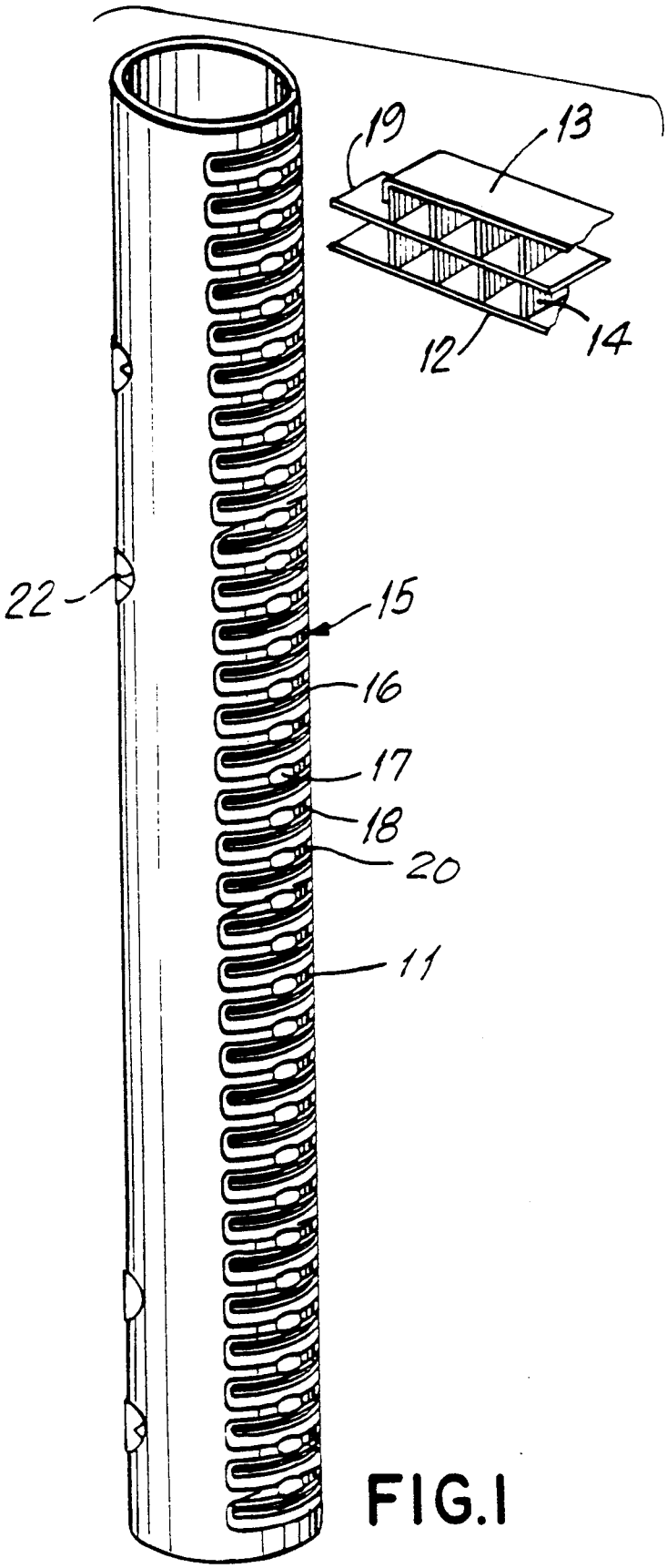
FIG. 1 shows a perspective view of an embodiment of the present invention in which the surface of the header has ribs with flattened portions and slots.

An exemplary embodiment of the present invention is shown in FIG. 1. This embodiment comprises a header portion 11 into which a multiplicity of tubes 12, which are separated by separators 14, per example serpentine fins, and if desired, having a side plates 13, can be inserted into slots 16 in the header surface portion or tube member receiving surface portion 15.

Figure 6:
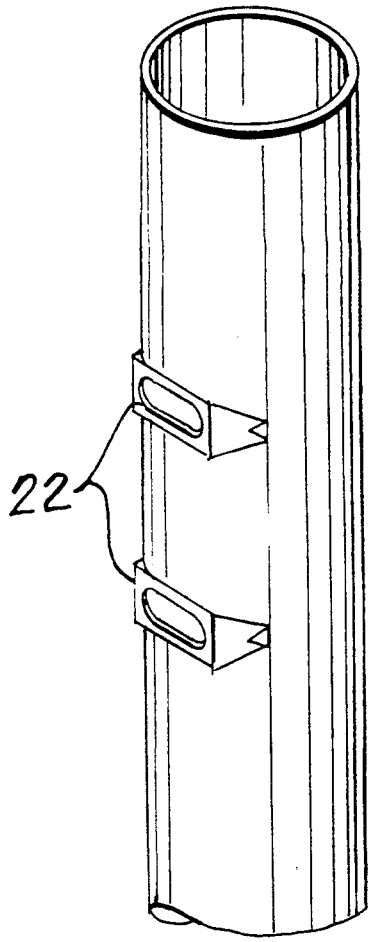
FIG. 6 shows a perspective view of an embodiment of the present invention showing the header and bosses.

As can be seen in the figures, the header surface portion 15 is provided with a series of generally parallel elongated slots or holes 16 which receive the open ends 19 of tubular elements 12. The tubular elements 12 can be sealed within the slots or holes 16 by any suitable means as well as bonded thereto sufficiently so a to provide structural integrity especially at such pressures as the heat exchanger assembly will be employed. Bosses 22 (FIG. 6) opposite apex flats 17 assist in holding the header during the insertion of the open ends 19 of tubes 12 in slots 16 on header portion 11.

The portion of each header portion surface 15 between the elongated slots 16 comprise center portions 20 which are disposed generally above said elongated slots 16. At the apex of each center portion 20 is an ape flat 17 and a side portion and side portion flat 18 which runs downwardly from apex flat 17 in both directions from the apex thereof. The apex flat 17 and the downward generally circumferential side portion flat 18 aid in creating a steep funnel effect for camming the tubes into the header slots. A camming surface 23 extends longitudinally from each center portion 20 and the camming surfaces 23 extend inwardly in the header portion surface 15. Adjacent center portions 20 and the camming surfaces 23 define each of the elongated slots 16.

Figure 5:
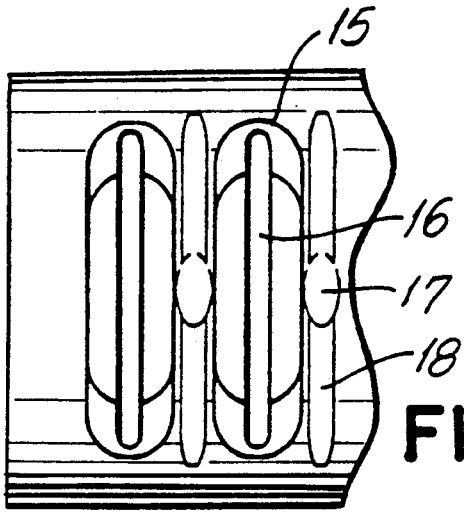
FIG. 5 is a top plan view of a portion of the embodiment shown in FIG. 2.
Figure 2:
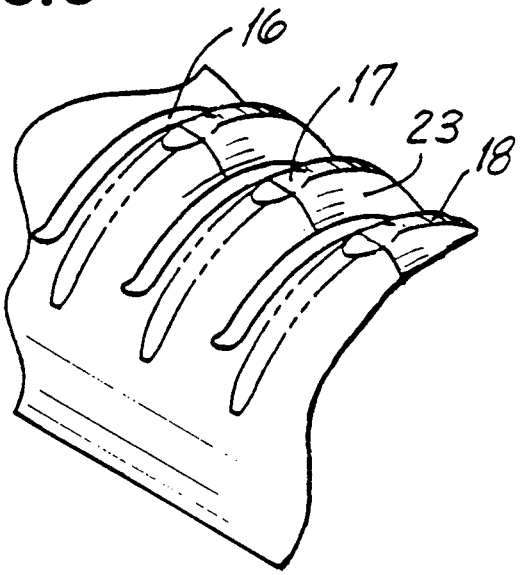
FIG. 2 is a closer view of a portion of the embodiment of FIG. 1 to better show the head surface portions.
Figure 4:
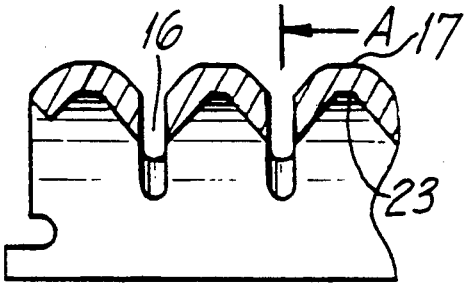
FIG. 4 is a cross-section of FIG. 3 through plane A-A.
Figure 3:
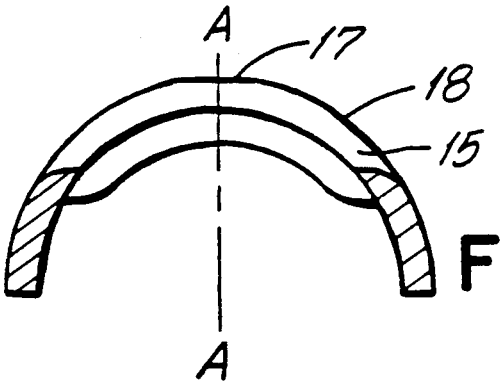
FIG. 3 is a cross section plane view of the FIG. 1 embodiment.

FIGS. 2, 3, 4 and 5 provide an enlarged view of a portion of header surface portion 15 to better illustrate the slot construction of the present invention. FIG. 2 is a perspective view of a portion of header surface portion 15 showing slots 16 and apex flats 17 and side portion flats 18. FIGS. 3, 4 and 5 show the same features as seen in FIG. 2 and provide different views of the header portion slot construction to provide a better understanding of the instant invention. Inside the header portion, flat 21, opposite apex flats 17 and 18, is formed during the stamping operation forming the present header and tank construction.

The header and tank construction of the present invention are made in a two-step procedure. The elongated slots and center portion flats are provided by a punching and stamping operation against a die in the interior of the header construction. In this step the elongated slots and center portions with apex flats are formed. The inside flat opposite the apex flat also occurs because of the presence of the die. A flattened area inside the header portion between the slots is then formed as a result of the stamping operation. These flattened portions in the interslot areas increase the funnel effect and enhance the manufacturability of the heat exchangers.

What is claimed is:

1. A heat exchanger comprising spaced generally parallel tubular header and tank constructions said tubular header and tank constructions comprising:

a tube member receiving surface and a base surface; said tube member receiving surface having a plurality of longitudinally spaced apart elongated slots for receiving tube members and a plurality of center portions disposed between each pair of slots; each center portion having a substantially flat apex portion and a pair of substantially flat circumferential side portions extending transversely from each substantially flat apex portion; and a camming surface for facilitating the insertion of tube members into said slots extending longitudinally from center portions toward each adjacent slot; and a plurality of tube members whose opposite open ends are inserted in aid elongated, spaced receiving slots in the tube member receiving surfaces of the header and tank constructions and extending between said spaced generally parallel header and tank constructions.

2. A heat exchanger according to claim 1, further comprising at least one boss on said base surface wherein said boss is located opposite said substantially flat apex portion.

3. A heat exchanger according to claim 1, further comprising a flat on an inside surface of said tube member receiving surface opposite said substantially flat apex portion.

4. A tubular header and tank construction for use in a heat exchanger comprising:

a tube member receiving surface and a base surface; said tube member receiving surface having a plurality of longitudinally spaced apart elongated slots for receiving tube members and a plurality of center portions disposed between each pair of slots; each center portion having a substantially flat apex portion and a pair of substantially flat circumferential side portions extending transversely from each substantially flat apex portion; and a camming surface for facilitating the insertion of tube members into said slots extending longitudinally from center portions toward each adjacent slot.

5. A header and tank construction according to claim 4, further comprising at least one boss on said base surface wherein said boss is located opposite said substantially flat apex portion.

6. A header and tank construction according to claim 4, further comprising a flat on an inside surface of said tube member receiving surface opposite said substantially flat apex portion.

* * * * *